US006874181B1

(12) United States Patent
Connolly et al.

(10) Patent No.: US 6,874,181 B1
(45) Date of Patent: Apr. 5, 2005

(54) THERAPEUTIC BED

(75) Inventors: Patrick Joseph Connolly, deceased, late of Athlone (IE); by Una Connolly, legal representative, Athlone (IE); Chinnathamby Vijayendran, Coventry (GB)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/701,739

(22) PCT Filed: Jun. 3, 1999

(86) PCT No.: PCT/IE99/00049

§ 371 (c)(1),
(2), (4) Date: Jun. 28, 2001

(87) PCT Pub. No.: WO99/62454

PCT Pub. Date: Dec. 9, 1999

Related U.S. Application Data

(63) Continuation of application No. 09/099,397, filed as application No. PCT/IE96/00087 on Dec. 17, 1996, now Pat. No. 6,112,349.

(30) Foreign Application Priority Data

Dec. 18, 1995 (IE) ..... 950950
Jun. 3, 1998 (IE) ..... S980415

(51) Int. Cl.[7] ..... A61G 7/008

(52) U.S. Cl. ..... 5/609; 5/607; 5/429; 5/425; 5/503.1

(58) Field of Search ..... 5/607, 609, 503.1, 5/658, 424, 426, 429

(56) References Cited

U.S. PATENT DOCUMENTS

| | | | | |
|---|---|---|---|---|
| 1,644,043 A | | 10/1927 | Tiedemann | |
| 1,667,982 A | | 5/1928 | Pearson | |
| 1,740,906 A | | 12/1929 | Rothauszky et al. | |
| 2,103,693 A | | 12/1937 | Pohl | |
| 2,239,821 A | | 4/1941 | Knox | |
| 2,534,471 A | | 12/1950 | Norheim | |
| 2,613,371 A | | 10/1952 | Keyes | |
| 2,690,177 A | * | 9/1954 | Hogan | 602/34 |
| 3,238,539 A | * | 3/1966 | Koch | 5/607 |
| 3,286,707 A | | 11/1966 | Shafer | |
| 3,302,218 A | | 2/1967 | Stryker | |
| 3,434,165 A | | 3/1969 | Keane | 5/61 |
| 3,783,863 A | | 1/1974 | Kliever | |

(Continued)

FOREIGN PATENT DOCUMENTS

| | | |
|---|---|---|
| DE | 4429062 A | 2/1996 |
| FR | 1362417 | 4/1964 |
| GB | 1516488 | 7/1978 |
| WO | WO96/27356 | 9/1996 |
| WO | WO97/22323 | 6/1997 |

*Primary Examiner*—Michael F. Trettel
(74) *Attorney, Agent, or Firm*—Eric Cernyar

(57) ABSTRACT

A therapeutic bed (1) comprises a patient support platform (7) rotatably mounted on a base frame (4) for rotation about a longitudinal pivot axis between a supine support position and a prone support position. The base frame (4) is in turn mounted on a wheeled chassis (2) by pivot linkages (5) which allow tilting and raising and lowering of the base frame (4) on the chassis (2). Drive interlocks prevent rotation of the patient support platform (7) unless side rails (25) are locked on the patient support platform (7) and patient support flaps (40, 41) extending between the side rails (25) are locked together to secure a patient on the patient support platform (7). Guides (51) are provided at each end of the patient support platform (7) at the longitudinal rotational axis to guide patient care lines between a patient on the patient support platform (7) and associated devices externally of the patient support platform (7). This prevents entanglement of patient care lines as the patient support platform (7) rotates.

55 Claims, 15 Drawing Sheets

U.S. PATENT DOCUMENTS 3,827,089 A 8/1974 Grow
3,832,742 A 9/1974 Stryker
4,244,358 A 1/1981 Pyers
4,357,722 A 11/1982 Thompson
4,827,541 A 5/1989 Vollman et al.
4,841,585 A 6/1989 Masuzawa
4,868,937 A 9/1989 Connolly ..... 5/61
4,939,801 A 7/1990 Schaal et al.
4,947,496 A * 8/1990 Connolly ..... 5/607
4,987,622 A 1/1991 Shockey
5,131,105 A 7/1992 Harrawood et al.
5,131,106 A * 7/1992 Jackson ..... 5/613
5,152,024 A * 10/1992 Chrones et al. ..... 5/609
5,274,862 A 1/1994 Palmer, Jr. et al.
5,334,186 A * 8/1994 Alexander ..... 604/180
6,282,736 B1 * 9/2001 Hand et al. ..... 5/608
6,499,160 B2 * 12/2002 Hand et al. ..... 5/608
6,526,610 B1 * 3/2003 Hand et al. ..... 5/607

* cited by examiner

THERAPEUTIC BED

BACKGROUND OF THE INVENTION

This application claims priority to PCT/IE99/00049 filed Jun. 3, 1999, which entered the United States national stage on Jun. 28, 2001. This application also claims priority to PCT/IE96/00087 filed Dec. 17, 1996, which entered the United States national stage on Jun. 18, 1998, and a continuation of U.S. patent application Ser. No. 09/099,397 filed Jun. 18, 1998, which issued as U.S. Pat. No. 6,112,349 on Sep. 5, 2000. This application also claims priority to Ireland application 950950 filed on Dec. 18, 1995, on which PCT/IE96/00087 is based, and also claims priority to Ireland application S980415 filed on Jun. 3, 1998.

BACKGROUND OF THE INVENTION

This invention relates to a therapeutic bed, and in particular to prone positioning beds.

Patient positioning has been used for some time as a treatment for patient comfort, to prevent skin breakdown, improve drainage and to facilitate breathing. One of the goals of patient positioning has been maximisation of ventilation to improve systematic oxygenation. Various studies have demonstrated the beneficial effects of body positioning and mobilisation on impaired oxygen transport. The support of patients in a prone position can be advantageous in enhancing extension and ventilation of the dorsal aspect of the lungs.

The present invention particularly relates to therapeutic beds of the type comprising a base frame, a patient support platform rotatably mounted on the base frame for rotational movement about a longitudinal rotational axis of the patient support platform, and drive means for rotation of the patient support platform on the base frame.

In our previously filed patent application, publication no. WO 97\2323, we described a therapeutic bed of this type for supporting a patient in either a supine position or a prone position and for using kinetic therapy.

This type of bed is particularly suited for the treatment of patients with respiratory problems. The beds advantageously allow rotation of the patient on the patient support platform and, where required, rotation of the patient support platform into a prone support position which is particularly desirable in the treatment of patients with severe respiratory problems.

In such therapy, a patient may be heavily intubated with a number of tubes extending over a side of the bed between the patient on the bed and associated apparatus mounted on stands or the like alongside the bed for either delivering liquids to the patient or draining liquids from the patient. Also, there may be a number of wires extending from sensors on the patient to various monitors adjacent the bed. These ventilation and drainage tubes, medication supply tubes, monitoring cables and the like are collectively called patient care lines throughout this patent specification. The term "patient care lines" as used in this patent specification is taken to mean any tubes, pipes, conduits, cables and the like lines for delivery or drainage of fluids to or from a patient, for monitoring a patient's condition and generally speaking for treating a patient on the patient support platform of the bed. These patient care lines present a problem, particularly when rotating the patient support platform between a supine support position and a prone support position, in that they can easily become entangled and may be inadvertently pulled away from the patient. To avoid this a nurse or other attendant has to carefully handle and adjust the patient care lines as necessary whilst the bed is rotating. This can be extremely awkward. Access to the patient and the patient care lines is difficult when the patient support platform is at or approaching the prone support position.

Another problem that arises is in ensuring that the patient is correctly secured to the patient support platform before rotating the patient support platform away from a horizontal supine support position. Again, a nurse has to check all the patient retaining strapping, rails and supports are secure prior to rotation of the patient support platform into the prone support position. This tends to be very time consuming. Also, it is not always easy to check the strapping or other restraints are correctly and securely engaged.

To rotate the patient support platform between the supine support position and the prone support position, typically a number of nursing staff are required to rotate the patient support platform and at the same time, handle the tubing and wiring to prevent entanglement or dislodgement. Thus, a number of nursing staff may be diverted from other duties for a considerable time. Consequently, the operational efficiency is adversely effected and costs increased for the hospital.

The present invention is directed towards overcoming these problems.

SUMMARY OF THE INVENTION

Accordingly, a therapeutic bed operable to provide lateral rotational therapy in both the prone and supine positions is provided having a frame, a patient support platform mounted on the frame and rotatable about a longitudinal axis of rotation through substantially 180° from a patient face-up or supine position to a patient face-down or prone position, and a motor operationally engaged with the patient support platform to provide controlled rotational movement to the patient support platform. In one embodiment, the patient support platform comprises a hinged section that provides access to the back of a patient when the patient support platform is in the patient face-down or prone position. In another embodiment, the patient support platform comprises side rails that can be locked into place or that can be removed to facilitate mounting of patients on the patient support platform. The therapeutic bed also comprises a plurality of prone patient supports, including a head support, an abdomen support comprised of flexible material and which is adjustable to accommodate abdomens of varying sizes, and support pad sections that are split longitudinally to define adjustable support parts that are hingedly mounted to the corresponding opposite side rails. At least some of the prone patient supports are operable to be locked to each other with straps and fasteners. The head support includes a strap to support the patient's head. Many of the prone patient supports are separately adjustable.

In another embodiment, a therapeutic bed operable to provide lateral rotational therapy to a patient in both the supine and prone positions is provided comprising a frame; a patient support assembly mounted on the frame; wherein the patient support assembly comprises a patient support platform mounted on a circular structure having a center and a perimeter; and a motor operationally engaged with the patient support assembly to provide controlled rotational movement to the patient support assembly. The patient support assembly is rotatable about a longitudinal axis of rotation through substantially 180° from a patient face-up or supine position to a patient face-down or prone position; wherein the longitudinal axis of rotation of the patient support assembly is coaxial with the circular structure. The load from the patient support assembly is transferred to the frame through the perimeter of the circular structure. The circular support may comprise one or more ring-shaped rails mounted on guide rollers on the frame. Alternatively, the perimeter of the circular support may be cylindrically shaped or barrel-shaped.

Accordingly, an apparatus and method for treating a patient with respiratory problems, and in particular, adult respiratory distress syndrome, is provided in which a patient may be secured to a mechanically powered patient support platform; the patient rotated from a substantially supine position to a substantially prone position; and the patient alternately laterally rotated about a longitudinal axis of the bed across an arc spanning from between positive 15 to 62 degrees from the prone position to a negative 15 to 62 degrees from the prone position.

The invention is characterised in that there is provided guide means for patient care lines at one or both ends of the patient support platform for guiding the patient care lines between a patient on the patient support platform and associated apparatus externally of the patient support platform, said guide means being mounted at or adjacent the longitudinal rotational axis of the patient support platform.

Advantageously, the invention provides a bed incorporating a patient care line management system for optimum handling of patient care lines particularly when rotating the bed between a supine support position and a prone support position. The risk of entanglement or dislodgement of the patient care lines is minimised as the lines are securely supported by the guide means during rotation of the patient support platform.

In a second aspect, the invention is characterised in that there is provided a retaining means for releasably securing a patient on the patient support platform, the retaining means being operatively connected to the drive means for rotation of the patient support platform to regulate rotation of the patient support platform in response to correct engagement of the retaining means. This construction advantageously prevents rotation of the patient support platform unless the patient is securely strapped or otherwise restrained on the patient support platform. Also, it gives a simple and quick indication to nursing staff as to whether or not the patient is properly secured on the patient support platform.

In a third aspect, the invention is characterised in that there is provided drive means which is operable for rotation of the patient support platform on the base frame, means for sensing the orientation of the patient support platform on the base frame, and means for controlling operation of the drive means in response to the sensed position of the patient support platform on the base frame. In this way, the rotation of the patient support platform can be readily controlled in a simple manner to rotate the patient support platform between a number of desirable orientations on the base frame. Also, the base support platform can be controlled to move between different orientations leaving a nurse free to attend to the patient if necessary while this is being carried out.

In one embodiment, means is provided for securing the patient care lines on the guide means.

In another embodiment, the guide means comprises a tubular guide for through passage of the patient care line or lines.

In a further embodiment, the tubular guide has a bore for through passage of the patient care lines and a bore insert is provided for engagement within the bore, the bore insert having a number of spaced-apart slots about a periphery of the insert, each slot for receipt of a patient care line, each slot being closed by a side wall of the bore when the insert is mounted within the bore.

In another embodiment, the guide means comprises a guide body having a number of patient care line receiving slots for reception of the patient care lines.

In a further embodiment, the guide means has a guide body with a number of spaced-apart peripheral slots for reception of patient care lines.

Preferably, each slot has a side opening, and closure means is engagable across the side opening to releasably retain a line within the slot.

In another embodiment, the closure means is a spring-loaded finger normally biased into a slot closing position across the side opening and retractable against spring bias for insertion and removal of a line into or from the slot.

Preferably, the closure means is a quick-release strip engagable across the side opening.

In a further embodiment, the guide body is movably mounted on the patient support platform for vertical movement of the guide body on the patient support platform.

Preferably, the guide body is slidably mounted on the patient support platform.

In another embodiment of the invention, there is provided retaining means for releasably securing a patient on the patient support platform, said retaining means being operatively connected to the drive means to regulate rotation of the patient support platform in response to correct engagement of the retaining means.

In a further embodiment, the retaining means comprises a number of pairs of support elements mounted between a head end and a foot end of the patient support platform, each pair of support elements comprising associated support elements mounted on opposite sides of the patient support platform and having a fastener to secure the support elements together to retain a patient on the patient support platform, sensing means associated with each fastener to sense correct engagement of the fastener, said sensing means being connected to a controller for controlling operation of the drive means.

In another embodiment, each fastener has a complementary pair of fastener parts, namely a first fastener part and a second fastener part, one fastener part being mounted on each of the pair of support elements, the first fastener part being normally biased out of engagement with the second fastener part, the first fastener part co-operating with the sensor when in an engaged position to indicate that the fastener parts are engaged.

In a further embodiment, the sensor has a magnetically operated switch and an operating magnet is mounted on the first fastener part to operate the switch.

In another embodiment, the support elements are mounted on side rails upstanding at each side of the patient support platform.

Preferably, each side rail is removably mounted on the patient support platform having means for releasably engaging the patient support platform, locking means to secure the rail on the patient support platform, rail sensing means to sense interlocking engagement of the rail with the patient support platform, said rail sensing means being operatively connected to the controller for the drive means such that the drive means will only operate if the rail is correctly engaged with the patient support platform.

In another embodiment, means is provided to lock each rail on the patient support platform when the patient support platform is in an inverted position.

In a further embodiment, one or more hinged panels are provided in the patient support platform to provide access to a patient when the patient support platform is in an inverted position, each panel having panel locking means to secure the panel in a closed position on the patient support platform, panel sensing means being provided to sense locking engagement of the panel with the patient support platform, said panel sensing means being operatively connected to the controller for the drive means such that the drive means will only operate if the panel is locked in a closed position on the patient support platform.

In another embodiment, there is provided means for sensing the orientation of the patient support platform on the base frame, and means for controlling operation of the drive means in response to the sensed position of the patient support platform on the base frame.

In a further embodiment, the sensing means comprises a ring mounted on the patient support platform co-axially with the rotational axis of the patient support platform, the ring having a first series of slots spaced at 1° intervals about the ring, the ring having a number of sets of location slots spaced-apart about the ring, each set of location slots giving an indication of a particular orientation of the patient support platform relative to the base frame, and a complementary position reader associated with the disc, the position reader being mounted on the base frame and having complementary light emitter and receiver pairs supported at opposite sides of the disc for cooperation with the slots in the disc to determine the orientation of the patient support platform on the base frame.

In another embodiment, the ring has a number of parking slots located about the ring defining a number of parking locations for the patient support platform on the base frame at which a locking bolt is engagable between the patient support platform and the base frame to lock the patient support platform on the base frame.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF THE INVENTION

Figure 1:
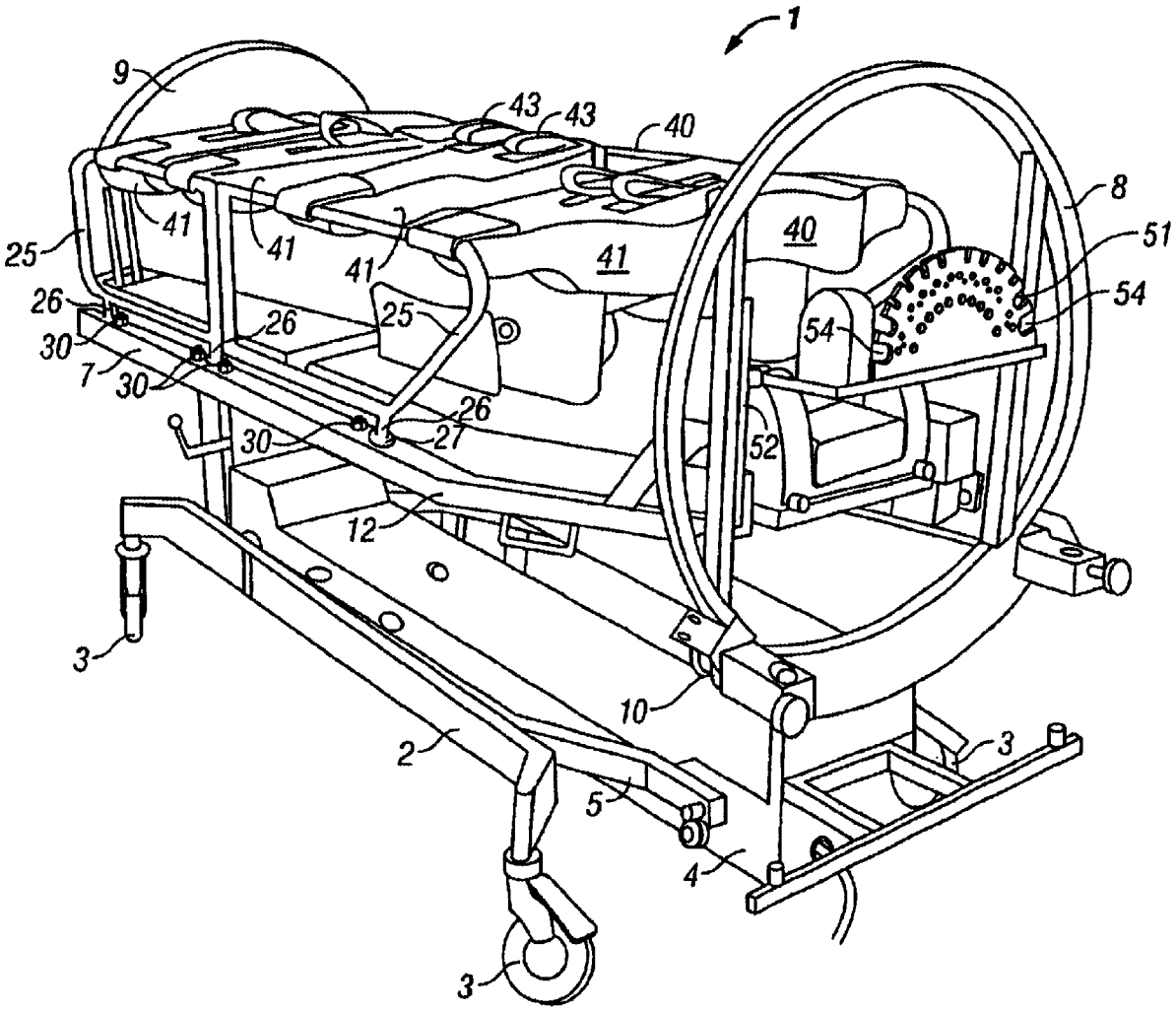
FIG. 1 is a perspective view of a therapeutic bed according to the invention.
Figure 2:
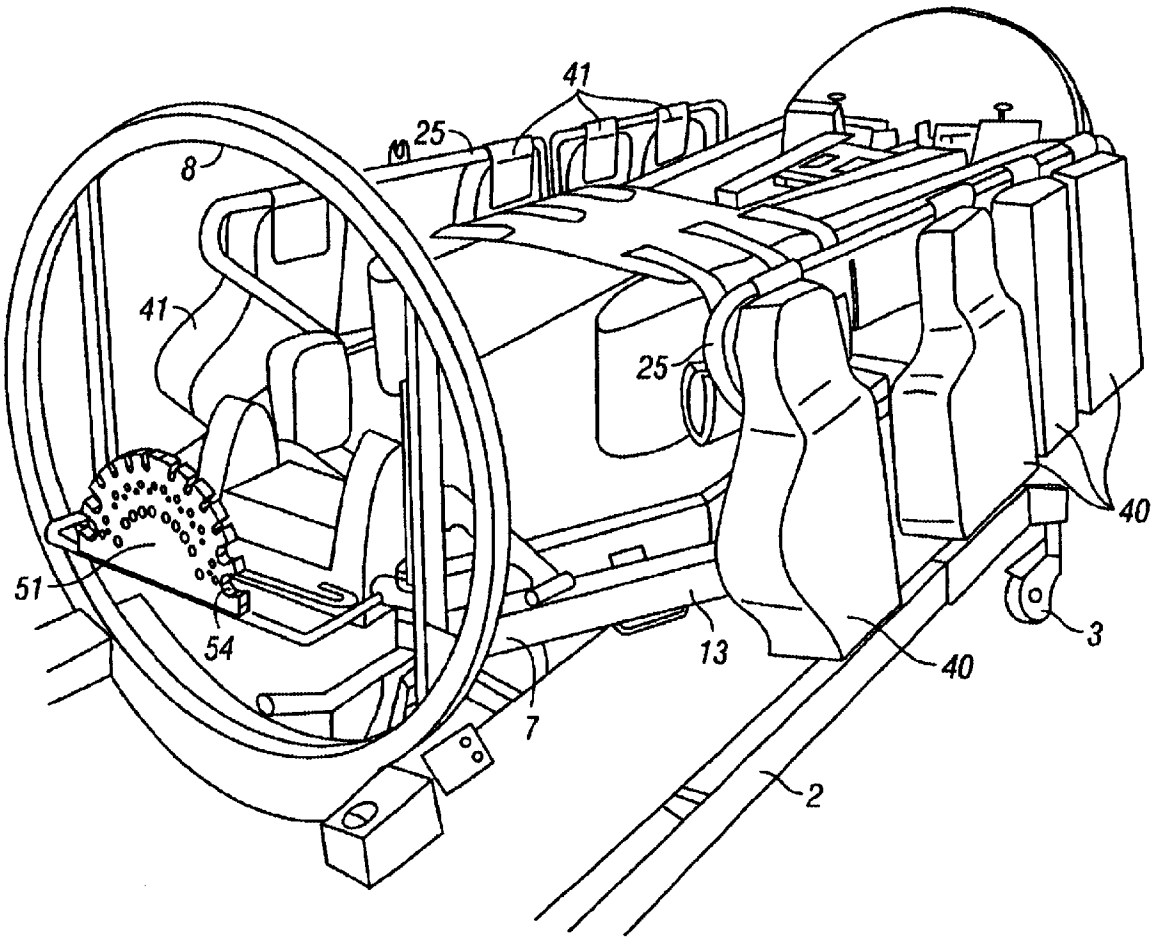
FIG. 2 is a another perspective view of the therapeutic bed, shown in another position of use.

Referring to the drawings there is illustrated a therapeutic bed according to the invention indicated generally by the reference numeral 1. The bed 1 comprises a ground engaging chassis 2 mounted on wheels 3. A base frame 4 is secured on the chassis 2 by pivot linkages 5. Rams 6 housed within the base frame 4 operate the pivot linkages 5 to raise and lower the base frame 4 on the chassis 2. The rams 6 may be operated to keep the base frame 4 level as it moves or may be operated to raise or lower one of the ends of the base frame 4 to tilt the base frame 4 about a transverse axis of the base frame 4 to move a patient support platform 7 carried on the base frame 4 into a Trendelenburg position. The patient support platform 7 is rotatably mounted on the base frame 4 for rotation about a longitudinal rotational axis of the patient support platform 7 between a supine support position shown in FIG. 1 and a prone support position shown in FIG. 3.

Figure 3:
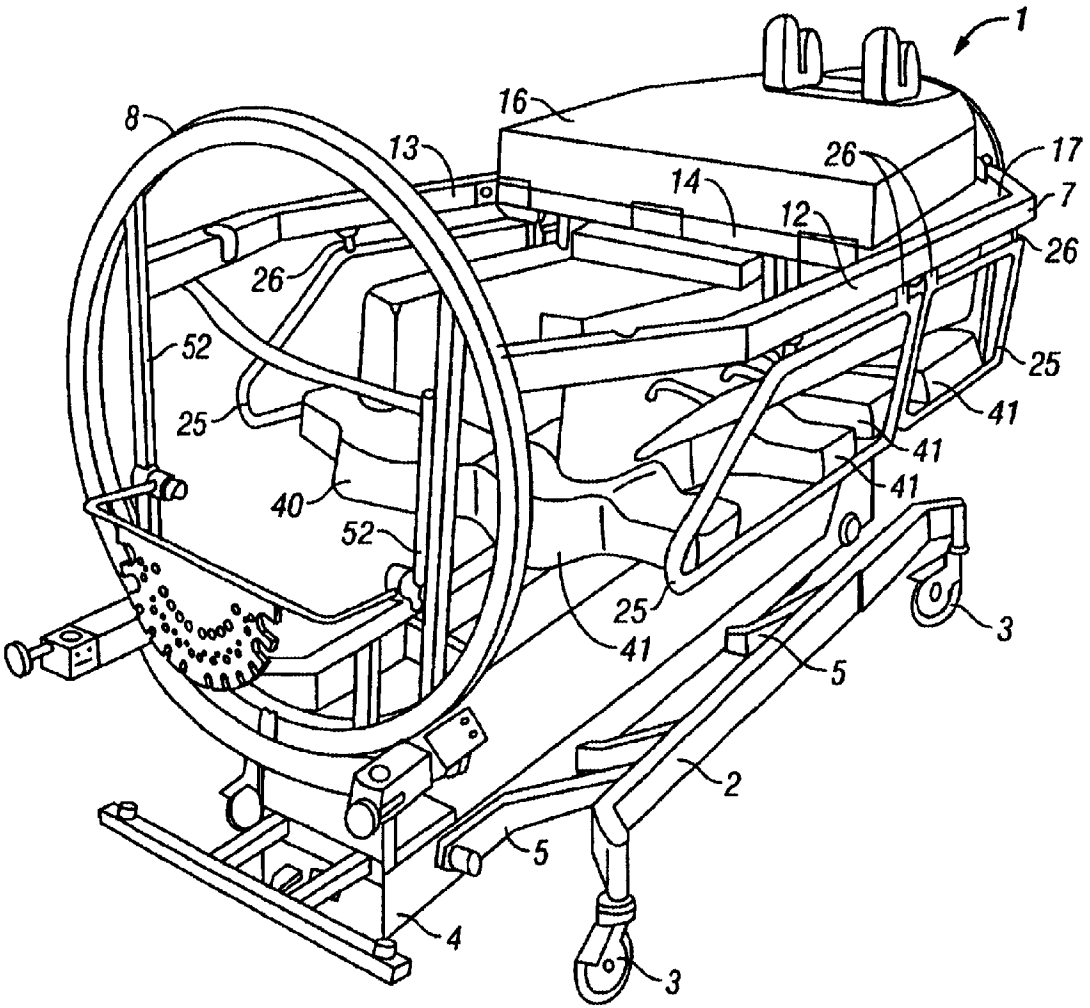
FIG. 3 is a further perspective view of the bed with a patient support platform of the bed shown in an inverted prone patient supporting position.
Figure 6:
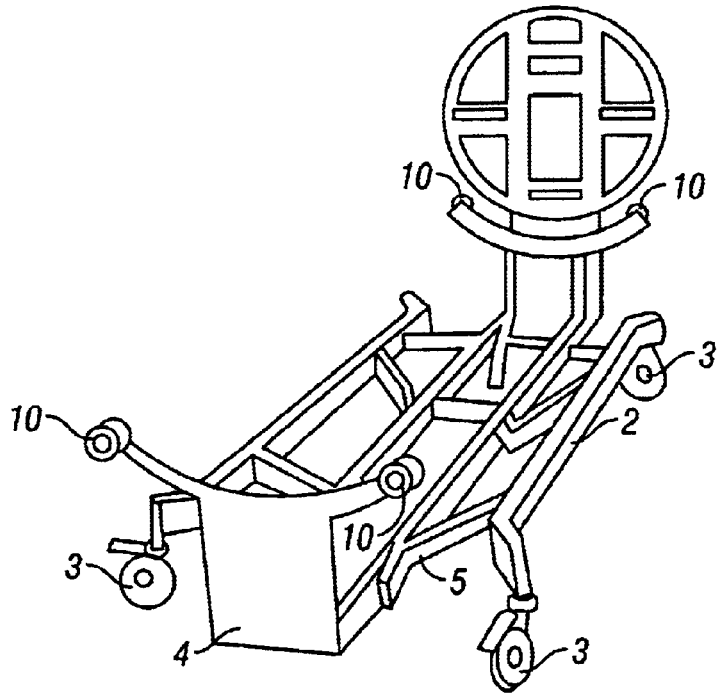
FIG. 6 is a perspective view of a base portion of the bed frame with a patient support platform of the bed removed.
Figure 9:
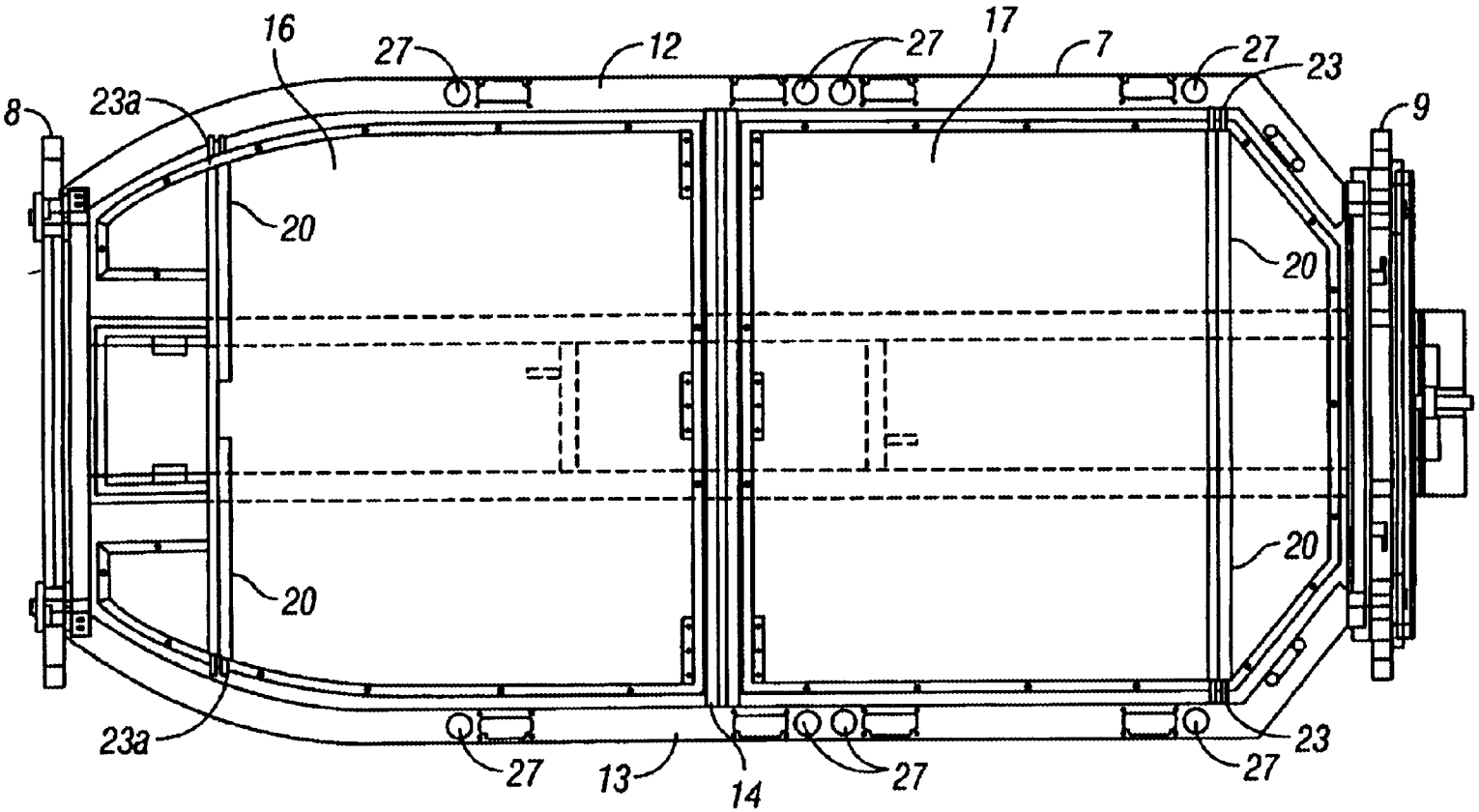
FIG. 9 is a plan view similar to FIG. 8 showing hinged panels of the patient support platform in place on the bed frame.
Figure 10:
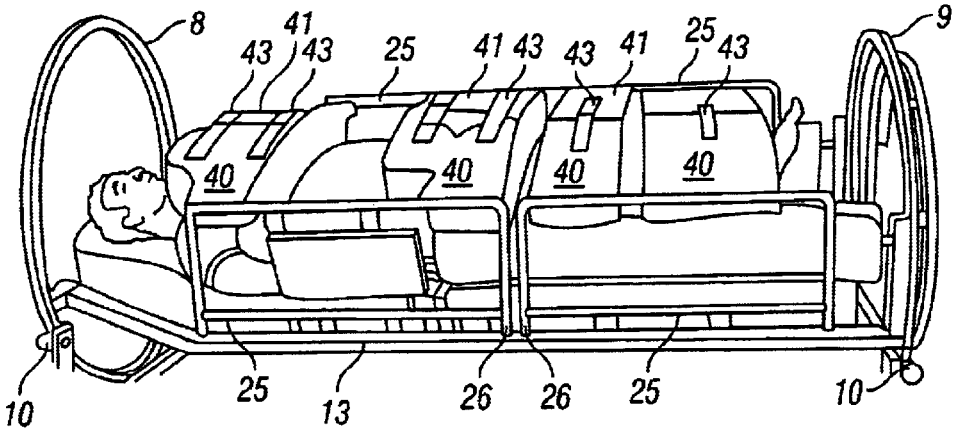
FIG. 10 is a perspective view of the bed in use and supporting a patient in a supine position.
Figure 11:
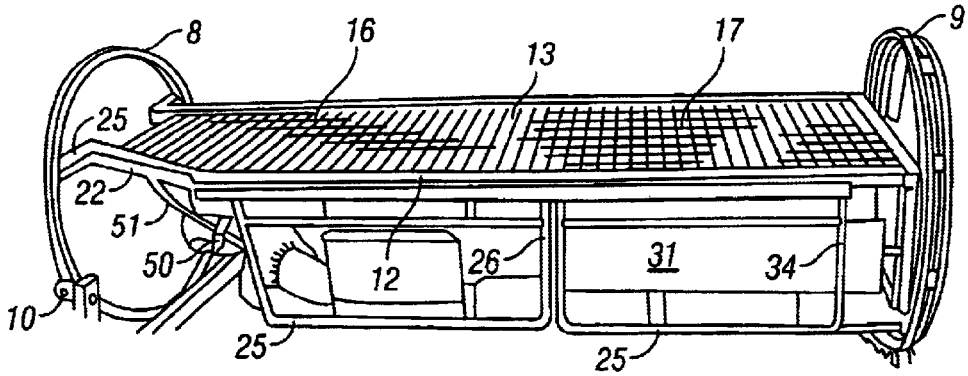
FIG. 11 is a perspective view of the bed in use, supporting a patient in a prone position.
Figure 12:
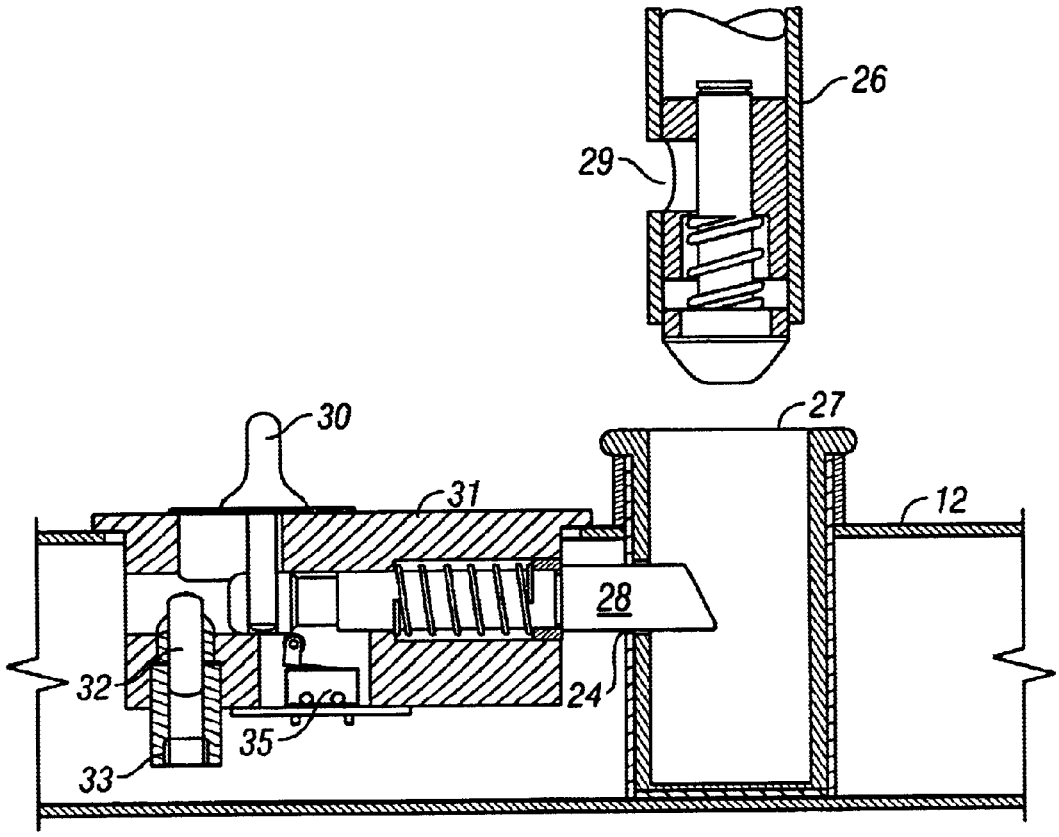
FIG. 12 is a detail exploded sectional view of a side rail locking mechanism for the bed.

The patient support platform 7 has a pair of upright end rings 8,9 each of which sits on and rotatably engages an associated pair of spaced-apart rollers 10 (FIG. 6) at each end of the base frame 4. Side support bars 12,13 extend between the end rings 8,9. A central cross bar 14 extends between the side support bars 12,13. Hinged panels 16,17 (FIG. 9) are hingedly connected to the cross bar 14 and can be opened when the bed 1 is in the prone position as illustrated in FIG. 3 for access to the back of a patient on the bed 1. It will be noted that this construction gives good access to the patient with minimal obstruction.

Figure 14:
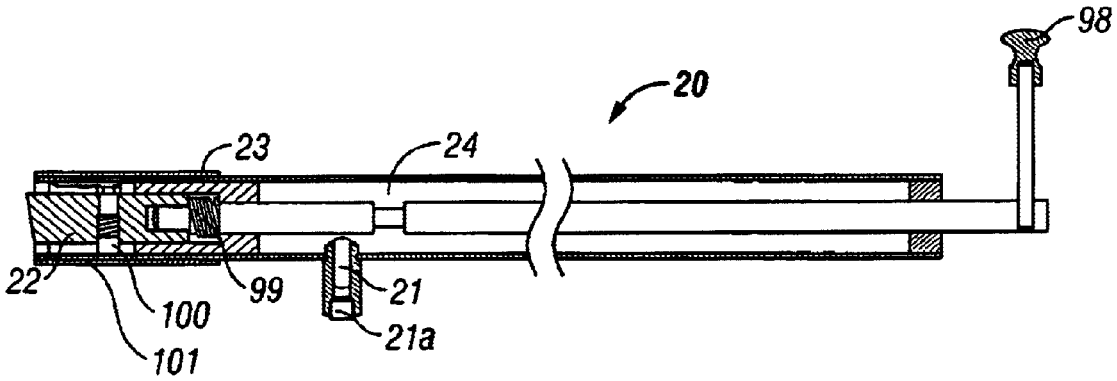
FIG. 14 is a sectional elevational view of a panel locking mechanism on the patient support platform.
Figure 15:
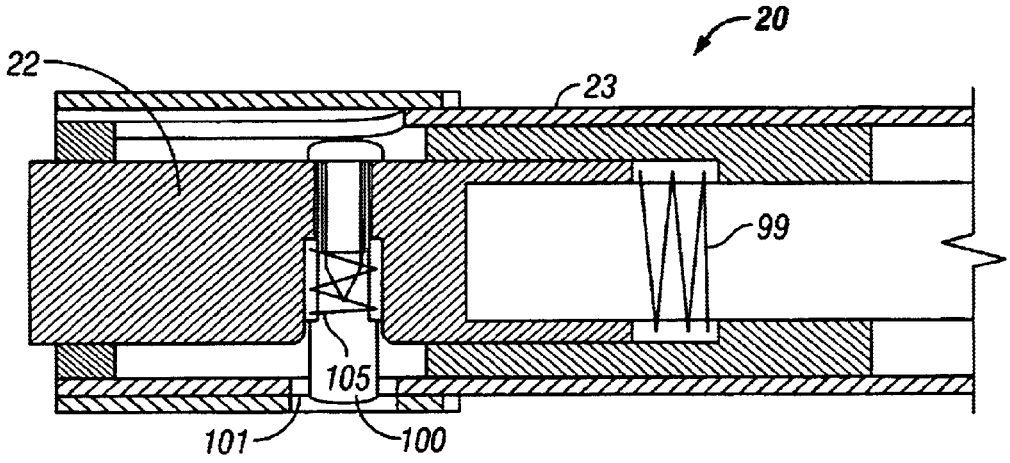
FIG. 15 is an enlarged detail sectional view of portion of the locking mechanism of FIG. 14.
Figure 16:
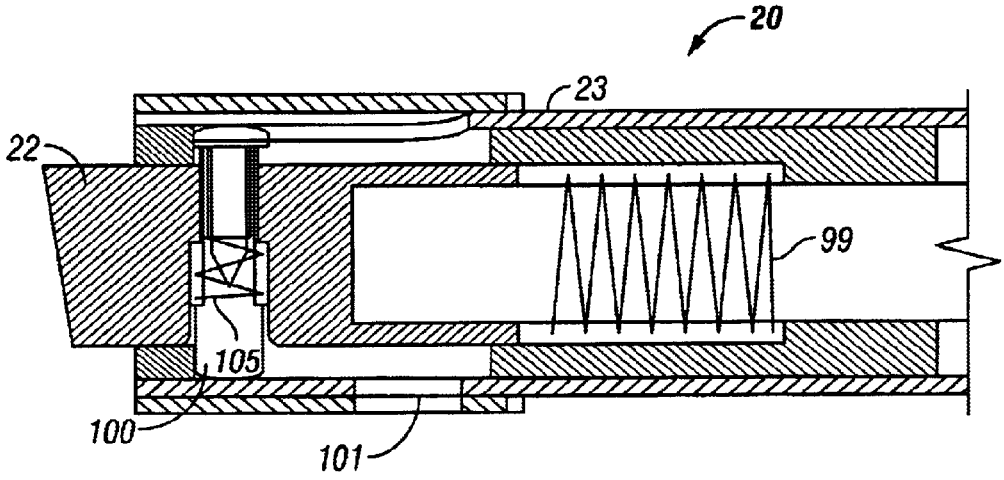
FIG. 16 is a view similar to FIG. 15 showing the locking mechanism in another position of use.

A slap shut mechanism 20 (FIGS. 9 and 14 to 16) is mounted on each panel 16,17 for engagement with the support bars 12,13 to securely lock the panels 16,17 in the closed position. A spring loaded locking pin 22 is slidably mounted within an elongate tubular housing 23 for movement between a retracted stored position (FIG. 15) and an extended position (FIG. 16) in which the locking pin 22 engages in an associated receiver slot 23*a* in the support bars 12,13. Sensors (not shown) detect correct locking engagement of each locking pin 22 with its associated receiver slot 23*a* and sends a signal to a rotational controller for the patient support platform 7 which prevents rotation of the patient support platform 7 unless both panels 16, 17 are securely locked on the patient support platform 7. A gravity pin 21 is slidable under gravity in an associated tube 21*a* on the housing 23 side wall for engagement with a complementary circumferential groove 24 in the locking bolt 22 when the patient support platform 7 is in the supine position to prevent opening of the panels 16, 17, the gravity pin 21 sliding out of engagement with the groove 24 when the patient support platform is in the prone position to allow opening of the panels 16, 17. A handle 98 is provided at an inner end of the locking pin 22 for manual release of the locking pin 22 which can be retracted against spring 99 within the housing 23. Thus, the panels 16, 17 are released for opening. In the retracted position, FIGS. 14, 15, a spring loaded catch 100 mounted on the locking pin 22 engages a slot 101 in a side wall of the housing 23 to retain the locking pin 22 in the retracted position. The catch 100 can be pressed into the housing 23 against spring 105 bias to release the locking pin 22 which is then urged outwardly by spring 99 into the outwardly extending engagement position shown in FIG. 16 for re-locking the panels 16, 17 on the patient support platform 7.

Figure 13:
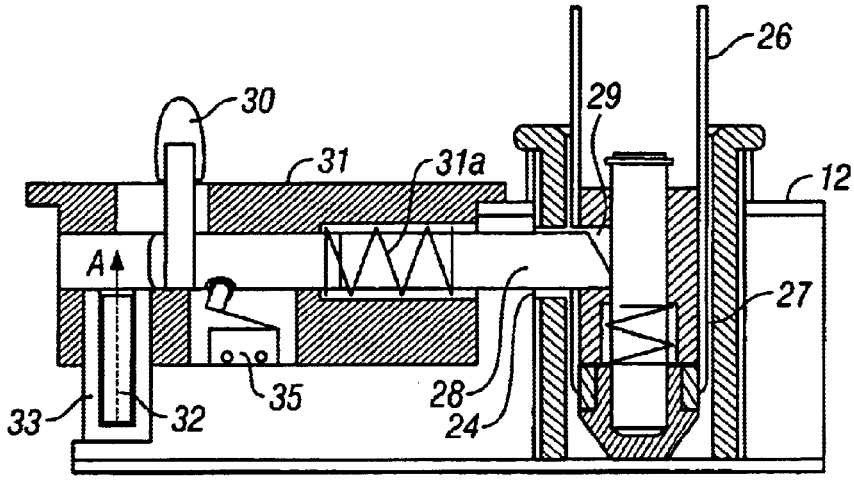
FIG. 13 is a detail sectional elevational view of a side rail locking mechanism for the bed shown in another position of use.

At each side of the patient support platform 7 upstanding side rails 25 are provided. Each side rail 25 has a downwardly extending stanchion 26 at each end which is engagable with a complementary socket 27 (see FIG. 13) in one of the support bars 12,13 of the patient support platform 7. Upon engagement of the stanchion 26 with the socket 27 a spring loaded locking pin 28 housed within the bar 12,13 is engagable through an opening 24 in the side wall of the socket 27 with a locking slot 29 in the stanchion 26. A handle 30 at an inner end of the locking pin 28 is operable to slide the locking pin 28 in an associated housing 31 housed within the bar 12, 13 for release of the stanchion 26. A spring 31*a* within the housing 31 urges the locking pin 28 outwardly of the housing 31 into a stanchion engaging position. It will be noted that an associated gravity operated retaining pin 32 is slidably mounted in a tubular casing 33 on the housing 31 such that when the patient support platform 7 is in the inverted prone position the pin 32 drops downwardly under gravity (in the direction of arrow A, FIG. 13) to prevent retraction of the pin 28 locking the rails 25 in position. A sensor 35 is engagable with each pin 28 to determine the position of the pin 28 to register if the pin 28 is engaged or disengaged with the stanchion 26. All of the sensors 35 are connected in series and are connected to a rotational controller for a motor which rotates the patient support platform 7 such that the motor will not operate until all the sensors 35 indicate that the pins 28 are properly engaged with the stanchions 26 so that the rails 25 are securely attached to and locked in position on the patient support platform 7.

Figure 17A:
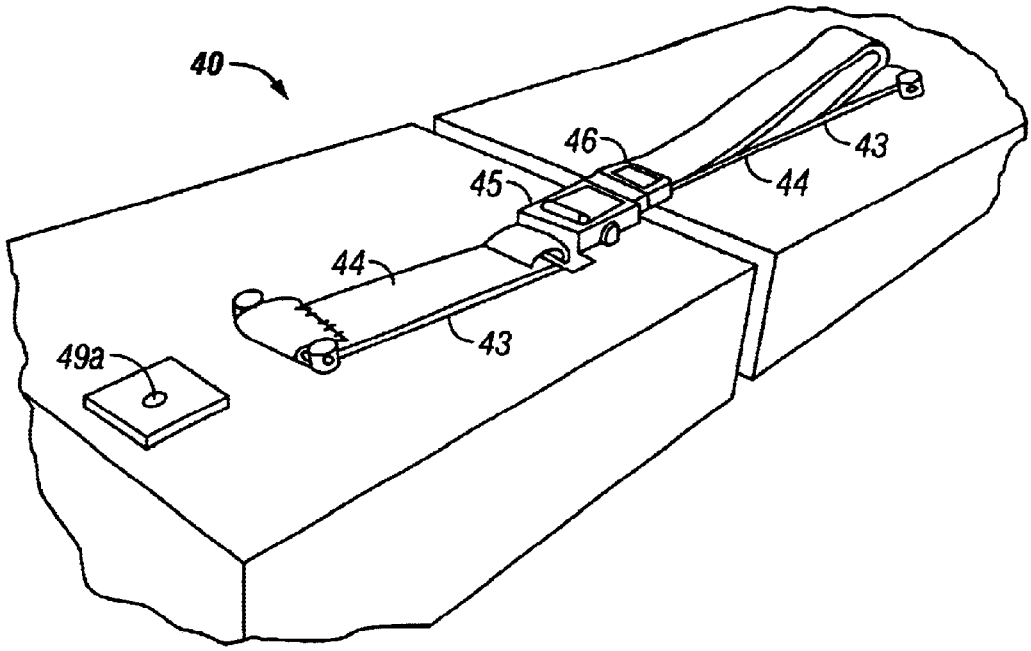
FIG. 17*a* is a detail perspective view of patient retaining flaps of the bed.
Figure 17B:
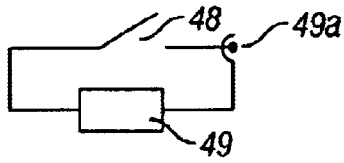
FIG. 17*b* is a circuit diagram for a rotational interlock incorporated in the flaps.
Figure 17C:
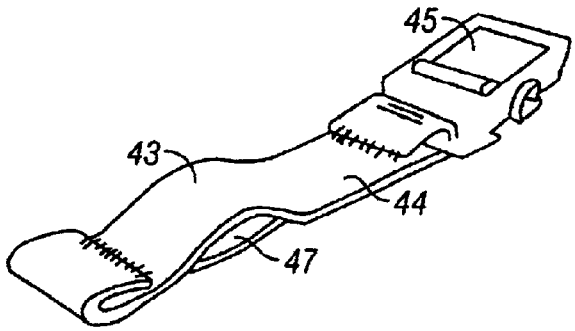
FIG. 17*c* is a detail perspective view of a patient retaining strap and buckle for securing the flaps.

To retain a patient on the patient support platform 7, associated pairs of patient support flaps 40,41 (FIG. 1) are pivotally mounted on opposite side rails 25 and can be secured together by locking straps 43 to securely retain a patient on the patient support platform 7 as described in our previous patent application Publication No. WO97/22323 (the details of which are incorporated herein by reference). Each strap 43 comprises a web 44 with either a buckle 45 (FIG. 17) or associated clip 46 at a free end of the web 44, the buckle 45 and clip 46 forming a quick release fastener. The web 44 when the buckle 45 is released is shortened by an elastic band 47, which is sewn in a stretched position onto one side of the web 44, to withdraw the buckle 45 from over a magnetically operated switch 48 mounted on the associated flap 41 on which the buckle 45 is mounted. The magnetic switch 48 is mounted inside each flap 41 and immediately below the magnet in the tightened buckle 45. A series circuit of the magnetic switch 48 and a resistor 49 terminates in a connector 49*a* which is accessible on an exterior of the flap 41. By choosing a unique value of resistor for each flap 41 and measuring it, correct closure of each buckle 45 can be validated. Thus, when the buckle 45, which incorporates a small magnet, is in the engaged position the magnetically operated switch 48 is operable to confirm that the buckles 45 and clips 46 are correctly joined and the patient is thus correctly secured on the patient support platform 7. Each of the fasteners must be correctly engaged before the patient support platform 7 can be rotated.

Figure 4:
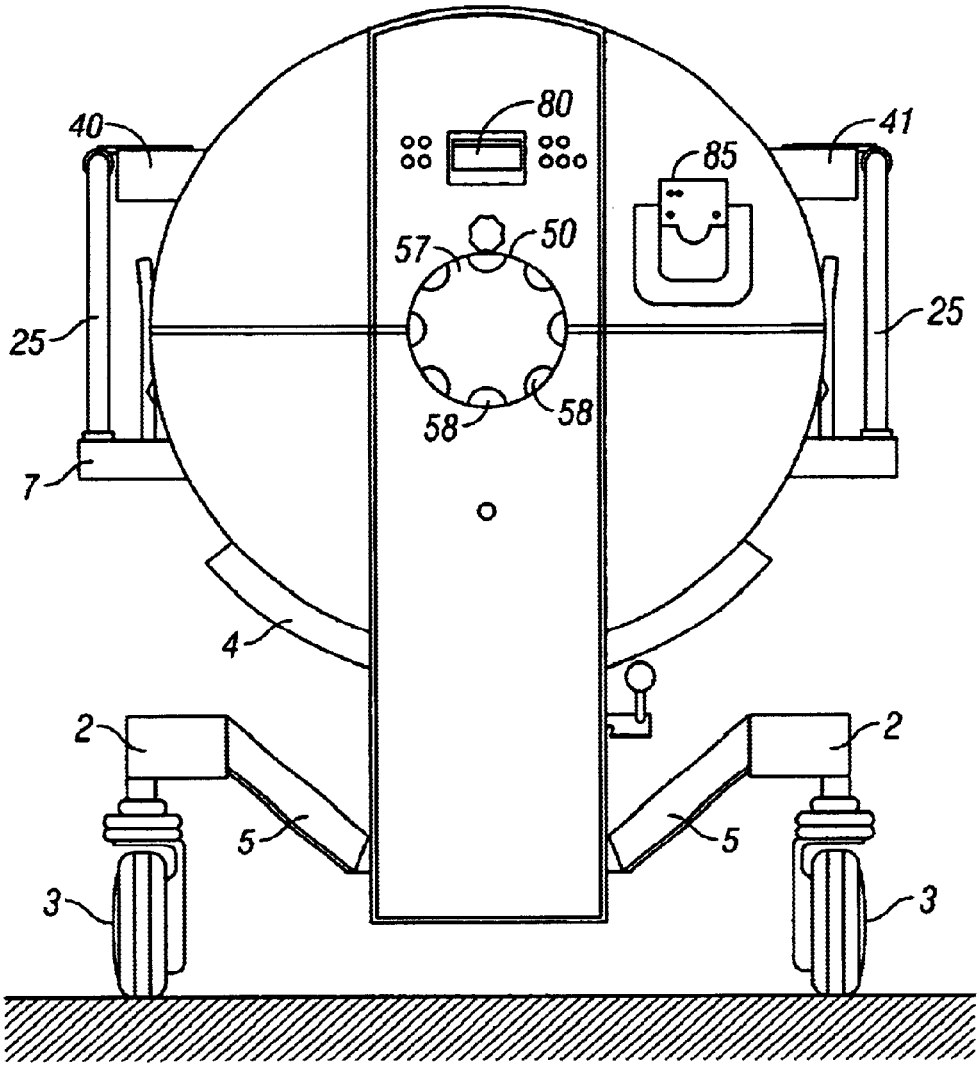
FIG. 4 is an end elevational view of the bed.

A hand-held controller 85 (FIG. 4) is mounted in a pocket 86 at the foot of the bed 1. This controller 85 has a contact for engagement with the connector 49*a* to allow the controller 85 to check the buckle 45 is properly engaged (the switch 48 is closed) and determine the value of the resistance 48 to identify the flaps 40, 41 being checked. Each of the flap pairs 40, 41 are checked in sequence starting at the foot of the bed and moving towards the head end of the bed. Preferably, the patient support platform 7 will not be released for rotation unless flap locking is confirmed in the correct sequence and the sequence is complete. This ensures all the flaps are checked together at the same time.

Assuming all the interlocks are clear, the hand-held controller 85 can be used to remotely send an operating signal to the rotation motor controller to rotate the patient support platform 7. A nurse can move around the bed 1 as the patient support platform 7 rotates, controlling rotation with the controller 85 to ensure there are no problems with the patient or the patient care lines during rotation.

Figure 5:
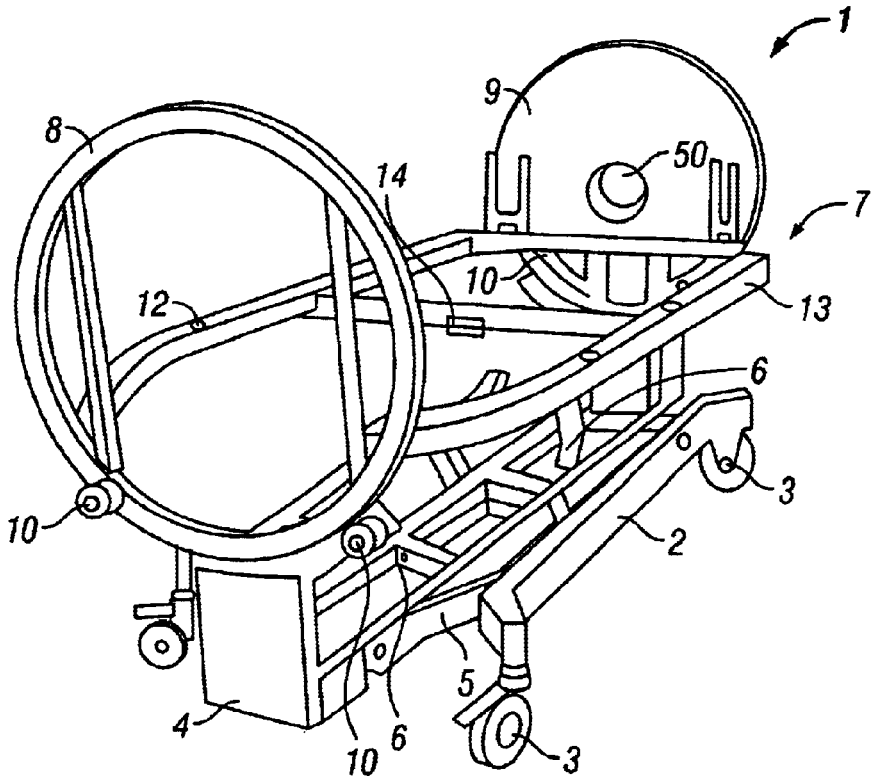
FIG. 5 is a perspective view of a frame of the therapeutic bed.

Management means for patient care lines such as tubes and sensor cables is provided on the bed. At a foot end of the bed the management means comprises a central opening 50 (FIG. 5) adjacent a longitudinal axis of the patient support platform 7 for supporting and through passage of the patient care lines. A care line holder 57 (FIG. 4) is removably engagable within the opening 50 and has a number of spaced-apart circumferential slots 56 each for reception of a patient care line. Each slot 58 is closed by the side wall of the opening 50.

Figure 18:
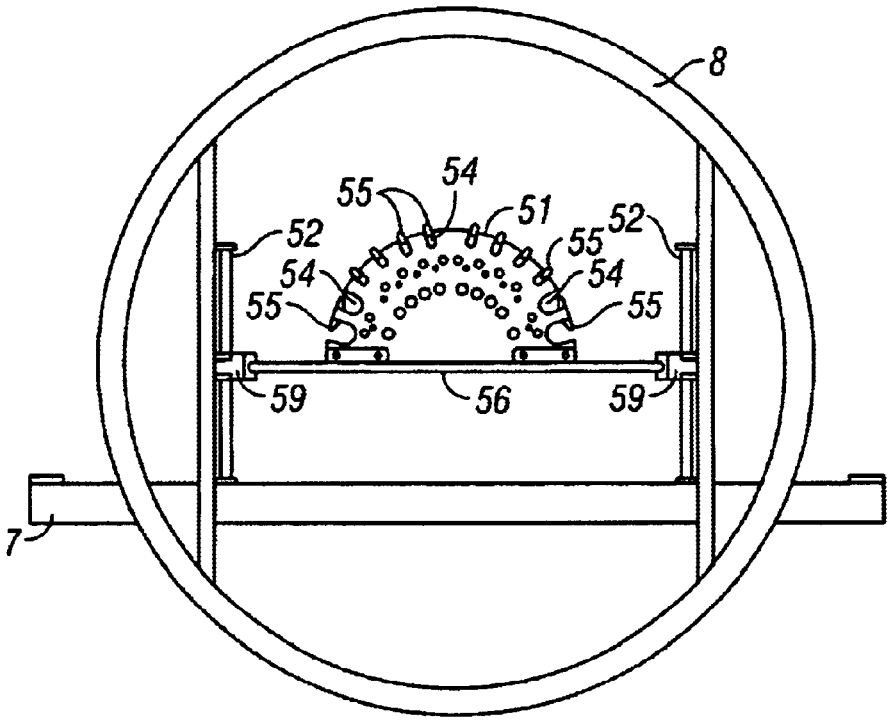
FIG. 18 is an elevational view showing a tube guide at one end of the bed.

At a head end of the bed the patient care line management means comprises a guide body 51 (FIGS. 1 and 18) mounted adjacent the longitudinal axis of the patient support platform 7 and slidable on associated rails 52 so that it drops beneath the head of the patient when the bed is in either the supine or the prone position. The guide 51 has a number of slots 54 for reception of patient care lines. The slots 54 may be of different sizes as shown to accommodate different lines. When the patient care lines are engaged with the slots 54, a spring loaded retaining finger 55 mounted across the inlets of each slot 54 retains the patient care line within the slot 54. The guide body 51 is mounted on a rod 56 which is rotatably mounted on sliders 59 which slidably engage the rails 52. Thus, the guide body 51 can be rotated out of the way for better access to a patient's head if necessary. It will be appreciated that this patient care line management by leading the patient care lines axially outwardly at each end of the bed greatly facilitates handling of the patient care lines when moving the patient support platform between the supine and prone support positions. Also, the patient care lines are securely held to prevent inadvertent withdrawal from a patient.

Figure 19:
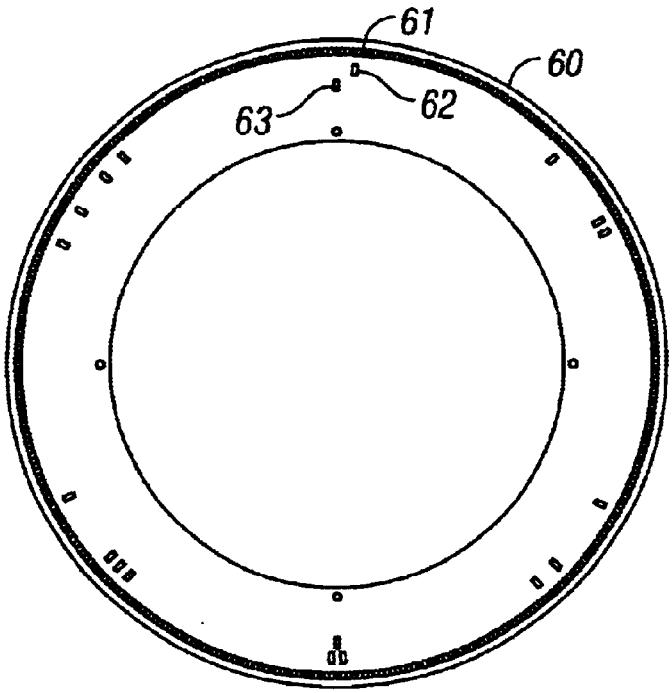
FIG. 19 is a detail elevational view of a rotary encoder ring forming portion of a rotational control mechanism for the patient support platform of the bed.
Figure 20:
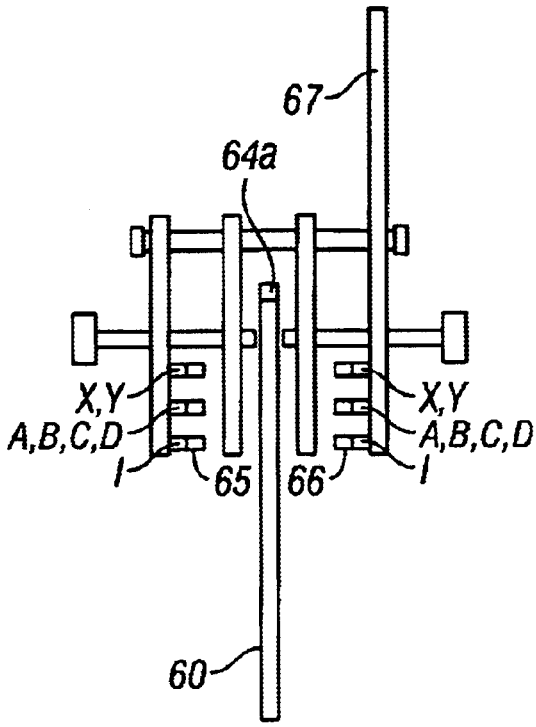
FIG. 20 is a detail side elevational view of a rotary encoder forming portion of the bed.

A drive for the patient support platform can be of the type described in our Patent Specification No. WO97/22323 (the details of which are incorporated by reference), essentially comprising a belt drive between the patient support platform 7 and an associated electric motor on the base frame 4 at a foot end of the bed 1. In this case however operation of the motor is controlled by a rotary opto encoder comprising a code disc 60 with three concentric tracks of slots 61, 62, 63, see FIGS. 19 to 21 and a complementary position reader 64. An outer angle track 61 comprises slots at 1° intervals. An intermediate track 62 has slots to provide index identification and an inner index track 63 has slots in line with the lock ring park position. The disc 60 is attached to the patient support platform 7 and the associated position reader 64 is mounted on the base frame 4. The position reader 64 has a channel 64*a* for reception and through passage of an outer portion of the disc 60. Light emitters 65 are mounted at one side of the channel 64*a* and complementary light receivers 66 are mounted at the opposite side of the channel 64*a*. The emitters 65 and receivers 66 co-operate with the associated slots 61, 62, 63 in the disc 60 to indicate the orientation of the patient support platform 7 on the base frame 4. Seven infra-red emitter/detector pairs 65, 66 are used in the optical system to decode the positional information. The outer track 61 comprises 360 sets of slots 70 and spaces 71. Ideally, a slot 70 occupies 0.5 degree of the circle, a slot 70 and space 71 together occupying 1 degree. The inner track 63 consists of a number of narrow slots 74, each corresponding to a locking position in which an associated locking bolt 75 (FIG. 7) is engagable between the base frame 4 and the patient support platform 7. The locking bolt 75 is slidably mounted on the base frame 4 for engagement with and release from associated locking hobs on the ring 9 of the patient support platform 7. The locking pin 75 serves to mechanically anchor the patient support platform 7 on the base frame 4 and also operates an on/off switch for the rotation motor, preventing operation of the motor when the locking pin 75 is engaged with the patient support platform 7. Each slot 74 should be exactly in line with the centre of an associated locking hole 75*a* on the patient support platform 7, the narrowness of the slot 74 determining the accuracy of lock positioning. The intermediate track 62 is used to assign a unique binary code to each locking position 1. Each locking position has a set of holes 76 (varying in number from one to four holes 76). The unique pattern of holes 76 at each locking position conveys locking angle information to the controller for controlling rotation of the patient support platform 7. The binary pattern of the holes is shown in the table below.

| | Holes 76 (FIG. 21) | | | |
|---|---|---|---|---|
| LockPin position | D | C | B | A |
| 1 | 0 | 0 | 0 | 1 |
| 2 | 0 | 0 | 1 | 0 |
| 3 | 0 | 0 | 1 | 1 |

-continued

| | Holes 76 (FIG. 21) | | | |
|---|---|---|---|---|
| LockPin position | D | C | B | A |
| 4 | 0 | 1 | 0 | 0 |
| 5 | 0 | 1 | 0 | 1 |
| 6 | 0 | 1 | 1 | 0 |
| 7 | 0 | 1 | 1 | 1 |
| 8 | 1 | 0 | 0 | 0 |
| 9 | 1 | 0 | 0 | 1 |
| 10 | 1 | 0 | 1 | 0 |

The binary weighting of the four holes are, A=1, B=2, C=4, D=8. In the table, the presence of a hole is indicated by 1, absence of a hole by 0.

Seven infra-red emitter detector pairs 65,66 are used in the optical system to decode the positional information.

Figure 21:
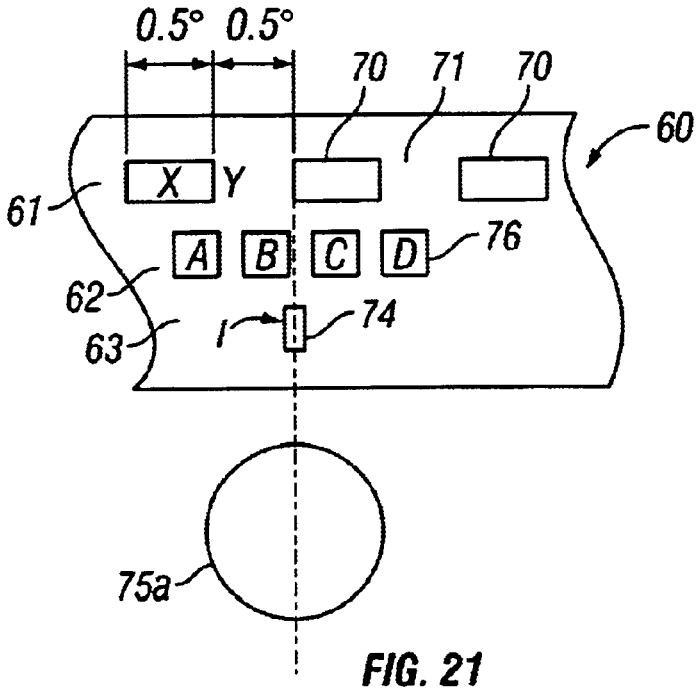
FIG. 21 is a detail view showing portion of the rotary encoder ring.

The emitter/detector pairs 65, 66 are positioned at A, B, C, D, I, X and Y as shown in FIG. 21.

When a detector 66 sees an emitter 65 through a slot or hole in the disc 60, it produces an output of "1". Otherwise, it produces an output of "0". The incremental angle and direction information are read by X and Y. Every time a slot 70 passes over detector X, the angle is incremented or decremented by one. There are two spaced-apart detectors X and Y for the outer track 61 and the order in which the detectors X and Y see the emitter determines the direction. There are four spaced-part emitter/detector pairs A, B, C, D associated with the intermediate track 62 and these supply the pattern information to the controller to compute the locking angle information. There is one emitter/detector pair I associated with the inner track 63 and this supplies the locking position information. As the patient support platform 7 rotates the spaces between the slots interrupt infra-red beams passing between emitters 65 and receivers 66 on a support 67 on the base frame 4. Information from the infra-red detectors is processed by an optical processing controller to provide the angle of the patient support platform 7 which is indicated on a display screen 80 (FIG. 4) at a foot end of the bed 1.

Figure 7:
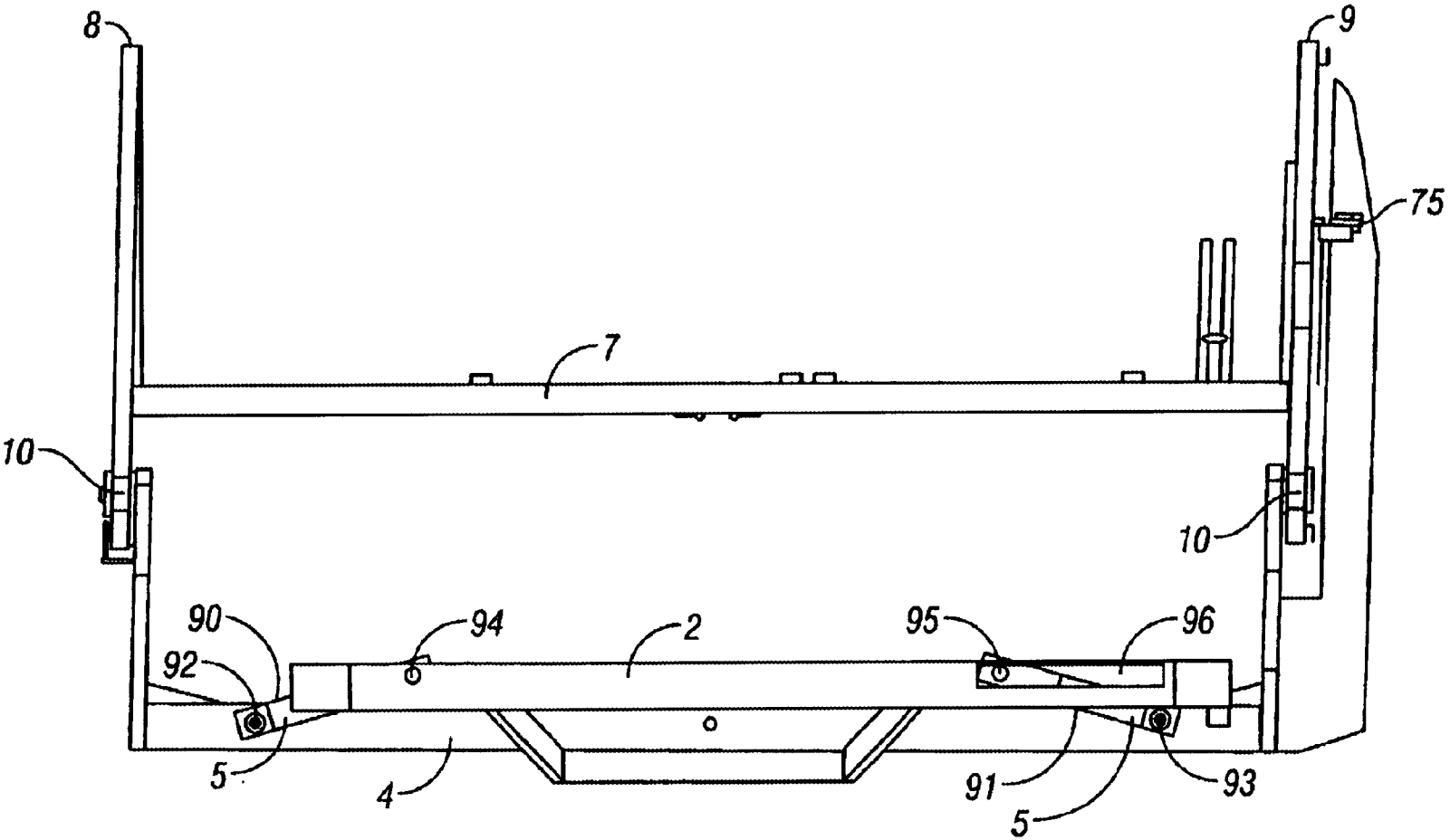
FIG. 7 is an elevational view of a frame of the bed.
Figure 8:
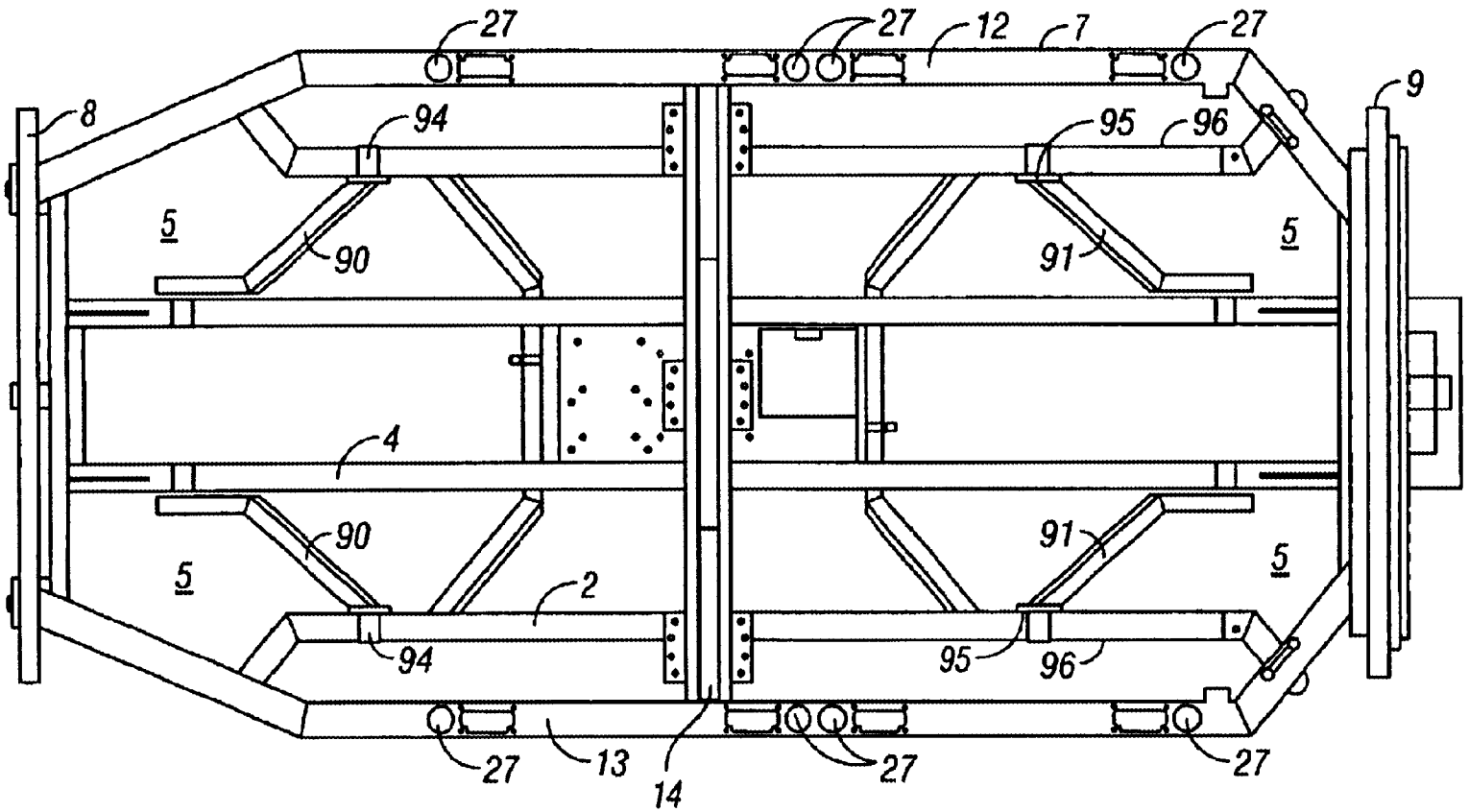
FIG. 8 is a plan view of the bed frame shown in FIG. 7.

As can be seen in FIG. 7, the pivot linkages 5 have pivot arms 90, 91 having inner ends which pivotally engage the base frame 4 by pivot pins 92, 93. At one end of the bed 1, an outer end of each pivot arm 90 pivotally engages the chassis 2 by a pivot pin 94, while at the other end of the bed 1, the outer end of each pivot arm 91 pivotally engages the chassis 2 by pivot pins 95 which are also longitudinally slidable in elongate slots 96 on the chassis 2. The rams 6 are operable to rotate the pivot pins 92, 93 on the base frame 4 for operation of the pivot linkages 5.

In use, sensors associated with the side rails 25 and the panels 16, 17 on the patient support platform 7 are connected to the drive controller for the patient support platform 7 such that the patient support platform cannot be rotated unless all the locks are correctly engaged. Further the sensors for the straps of the patient retaining flaps 40, 41 also need to indicate correct engagement before the patient support platform 7 can be rotated. It will also be appreciated that the delivery of the patient care lines such as tubes and other cables and conduits axially outwardly at each end of the patient support platform greatly facilitates management of the patient care lines during movement of the patient support platform between the supine and prone positions.

It will be noted that when the patient support platform is rotated from the supine support position into the prone support position, it will rotate through 200° and then return to the 180° or zero prone position. This function will centre the patient on the bed 1.

It will be appreciated that the patient support platform may be oscillated on the base frame or may be locked in a number of fixed orientations on the base frame.

It will also be appreciated that the invention provides a patient care line guide system for a hospital bed for neatly guiding patient care lines off each end of the bed.

The invention is not limited to the embodiments hereinbefore described which may be varied in both construction and detail within the scope of the appended claims.

What is claimed is:

1. A therapeutic bed comprising:

a base frame, a patient support platform rotatably mounted on the base frame for rotational movement about a longitudinal rotational axis of the patient support platform, a motor operable to rotate the patient support platform on the base frame, and a guide body defining one or more patient care line receiving slots operable to guide one or more patient care lines from an apparatus external of the patient support platform to a patient on the patient support platform.

2. A therapeutic bed as claimed in claim 1, wherein the guide body is mounted on the patient support platform.

3. A therapeutic bed as claimed in claim 1, further comprising a bore for through passage of the patient care lines and wherein the guide body comprises a bore insert that is provided for engagement within the bore, the bore insert defining a number of spaced-apart slots about a periphery of the insert, each slot for receipt of a patient care line, each slot being closed by a side wall of the bore when the insert is mounted within the bore.

4. A therapeutic bed as claimed in claim 1 wherein the slots are spaced apart along the periphery of the guide body.

5. A therapeutic bed as claimed in claim 1 wherein each slot has a side opening, and a spring-loaded finger normally biased into a slot closing position across the side opening and retractable against the spring bias, the finger facilitating secured retention of a line and also facilitating insertion and removal of a line into or from the slot.

6. A therapeutic bed as claimed in claim 1 wherein each slot has a side opening and a quick-release strip engagable across the side opening.

7. A therapeutic bed as claimed in claim 1 wherein the guide body is movably mounted on the patient support platform.

8. A therapeutic bed as claimed in claim 1 wherein there is provided a plurality of prone support elements mounted between a head end and a foot end of the patient support platform for releasably securing a patient on the patient support platform, said prone support elements being operatively connected to the motor to regulate rotation of the patient support platform in response to correct engagement of the plurality of prone support elements.

9. A therapeutic bed as claimed in claim 8 wherein the plurality of prone support elements comprise matching pairs of support elements mounted on opposite sides of the patient support platform and fasteners to secure the matching support elements together to retain a patient on the patient support platform, sensors associated with each fastener that sense correct engagement of the fastener, said sensors being connected to a controller for controlling operation of the motor.

10. A therapeutic bed as claimed in claim 9 wherein each fastener has a complementary pair of fastener parts, namely a first fastener part and a second fastener part, one fastener part being mounted on each of the pairs of support elements, the first fastener part being normally biased out of engagement with the second fastener part, the first fastener part cooperating with the sensor when in an engaged position to indicate that the fastener parts are engaged.

11. A therapeutic bed as claimed in claim 10 wherein the sensor has a magnetically operated switch and an operating magnet is mounted on the first fastener part to operate the switch.

12. A therapeutic bed as claimed in claim 9 wherein the support elements are mounted on side rails upstanding at each side of the patient support platform.

13. A therapeutic bed as claimed in claim 12 wherein each side rail is removably mounted on the patient support platform having means for releasably engaging the patient support platform, locking means to secure the rail on the patient support platform, rail sensing means to sense interlocking engagement of the rail with the patient support platform, said rail sensing means being operatively connected to the controller for the motor such that the motor will only operate if the rail is correctly engaged with the patient support platform.

14. A therapeutic bed as claimed in claim 12 wherein means is provided to lock each rail on the patient support platform when the patient support platform is in an inverted position.

15. A therapeutic bed as claimed in claim 1 wherein one or more hinged panels are provided in the patient support platform to provide access to a patient when the patient support platform is in an inverted position, each panel having panel locking means to secure the panel in a closed position on the patient support platform, panel sensing means being provided to sense locking engagement of the panel with the patient support platform, said panel sensing means being operatively connected to a controller for the motor such that the motor will only operate if the panel is locked in a closed position on the patient support platform.

16. A therapeutic bed as claimed in claim 1 wherein there is provided means for sensing the orientation of the patient support platform on the base frame, and means for controlling operation of the motor in response to the sensed position of the patient support platform on the base frame.

17. A therapeutic bed as claimed in claim 1, further comprising a ring mounted on the patient support platform coaxially with the longitudinal axis of the patient support platform, wherein the ring has a number of parking slots located about the ring defining a number of parking locations for the patient support platform on the base frame at which a locking bolt is engagable between the patient support platform and the base frame to lock the patient support platform on the base frame.

18. A therapeutic bed comprising:

a frame;

a patient support platform mounted on the frame and rotatable about a longitudinal axis of rotation through substantially 180° from a patient face-up or supine position to a patient face-down or prone position;

the patient support platform comprising a hinged section that provides access to the back side of a patient when the patient support platform is in the prone position;

a plurality of prone patient supports mounted to opposite sides of the patient support platform; and a motor operationally engaged with the patient support platform to move the patient support platform from the supine position to the prone position and to oscillate the patient support platform about an arc of rotation intersecting the prone position.

19. The therapeutic bed of claim 18, wherein at least some of the prone patient supports are hingedly mounted to the patient support platform.

20. The therapeutic bed of claim 18, wherein at least some of the prone patient supports are split adjacent the longitudinal axis of rotation of the patient support platform.

21. The therapeutic bed of claim 20, wherein at least some of the prone patient supports are operable to be locked to each other.

22. The therapeutic bed of claim 21, wherein at least some of the prone patient supports are hingedly mounted to the patient support platform.

23. The therapeutic bed of claim 20, wherein at least some of the prone patient supports are operable to be locked to each other with fasteners.

24. The therapeutic bed of claim 20, wherein at least some of the prone patient supports are operable to be locked to each other with straps and fasteners.

25. The therapeutic bed of claim 18, the patient support platform having side rails extending upwardly from opposite lateral sides of the patient support platform, at least some of the prone patient supports being mounted to the side rails of the patient support platform.

26. The therapeutic bed of claim 25, wherein at least some of the prone patient supports are hingedly mounted to the side rails of the patient support platform.

27. The therapeutic bed of claim 26, wherein at least some of the prone patient supports are split adjacent the longitudinal axis of rotation of the patient support platform.

28. The therapeutic bed of claim 27, wherein at least some of the prone patient supports are operable to be locked to each other.

29. The therapeutic bed of claim 27, wherein at least some of the prone patient supports are operable to be locked to each other with fasteners.

30. The therapeutic bed of claim 27, wherein at least some of the prone patient supports are operable to be locked to each other with straps and fasteners.

31. The therapeutic bed of claim 18, wherein one of the prone patient supports is an abdomen support adjustable to accommodate abdomens of varying sizes.

32. The therapeutic bed of claim 31, wherein the abdomen support is comprised of a flexible material.

33. The therapeutic bed of claim 18, wherein at least one of the prone patient supports comprises a strap to support the patient's head.

34. The therapeutic bed of claim 18, wherein the prone patient supports comprise a head support section separately adjustable from a shoulder and upper body support section separately adjustable from an abdomen support section separately adjustable from a lower body support section.

35. A therapeutic bed comprising:

a frame;

a patient support platform rotatably mounted on the frame about a longitudinal axis of rotation, the patient support platform being rotatable from a patient face-up or supine position to a patient facedown or prone position;

a motor operationally engaged with and operable to rotate the patient support platform from the supine to the prone position and to alternately rotate the patient support platform about the longitudinal axis of the bed through an arc of alternating rotation substantially centered at the prone position; and prone patient supports operable to retain a patient on the patient support platform and to provide support to the patient while the patient support platform is rotated from the supine to prone position and while the patient support platform is alternately rotated through said arc of alternating rotation;

wherein the therapeutic bed is operable to provide lateral rotation therapy to the patient while the patient is in the prone position.

36. The therapeutic bed of claim 35, wherein the motor is operationally engaged with and operable to rotate the patient support platform through an arc of alternating rotation spanning from between positive 15 to 62 degrees from the prone position to a negative 15 to 62 degrees from the prone position.

37. The therapeutic bed of claim 35, further comprising a pair of side rails extending upwardly from the patient support platform.

38. The therapeutic bed of claim 37, wherein the side rails are operable to be displaced from their upwardly extending position on the patient support platform to facilitate mounting of patients on the patient support platform.

39. A therapeutic bed comprising:

a frame;

a patient support platform mounted on the frame and rotatable about a longitudinal axis of rotation through substantially 180° from a patient face-up or supine position to a patient face-down or prone position;

a pair of side rails extending upwardly from the patient support platform; and a a motor operationally engaged with the patient support platform to move the patient support platform from the supine to the prone position and to provide controlled rotational movement to the patient support platform.

40. The therapeutic bed of claim 39, wherein the side rails are operable to be displaced from their upwardly extending position on the patient support platform to facilitate mounting of patients on the patient support platform.

41. The therapeutic bed of claim 40, wherein the side rails are operable to be locked into their upwardly extending position on the patient support platform.

42. The therapeutic bed of claim 39, further comprising prone patient supports mounted to the side rails.

43. The therapeutic bed of claim 42, wherein the side rails are operable to be displaced from their upwardly extending position on the patient support platform to facilitate mounting of patients on the patient support platform.

44. The therapeutic bed of claim 43, wherein the side rails are operable to be locked into their upwardly extending position on the patient support platform.

45. A therapeutic bed operable to provide lateral rotational therapy to a patient in both the supine and prone positions, the bed comprising:

a frame;

a patient support assembly mounted on the frame;

wherein the patient support assembly comprises a patient support platform mounted on a circular structure having a center and a perimeter, the patient support assembly being rotatable about a longitudinal axis of rotation through substantially 180° from a patient face-up or supine position to a patient face-down or prone position;

wherein the longitudinal axis of rotation of the patient support assembly intersects the center of the circular structure;

wherein load from the patient support assembly is transferred to the frame through the perimeter of the circular structure; and a motor operationally engaged with the patient support assembly to move the patient support platform from the supine position to the prone position.

46. The therapeutic bed of claim 45, wherein the circular support comprises at least one ring-shaped rail.

47. The therapeutic bed of claim 45, wherein the perimeter of the circular support is barrel-shaped.

48. The therapeutic bed of claim 45, wherein the circular support is cylindrically shaped.

49. The therapeutic bed of claim 45, wherein the circular support is mounted on guide rollers on the frame.

50. The therapeutic bed of claim 45, further comprising prone patient supports mounted to opposite sides of the patient support assembly.

51. The therapeutic bed of claim 50, wherein the patient support assembly further comprises side rails extending upwardly from the opposite lateral sides of the patient support assembly.

52. The therapeutic bed of claim 51, wherein at least some of the prone patient supports are mounted to the side rails.

53. The therapeutic bed of claim 52, wherein at least some of the prone patient supports are hingedly mounted to the side rails.

54. A method for treating a patient with respiratory problems comprising:

securing a patient to a mechanically powered patient support platform;

rotating the patient from a substantially supine position to a substantially prone position; and alternately laterally rotating the patient about a longitudinal axis of the bed across an are spanning from between positive 15 to 62 degrees from the prone position to a negative 15 to 62 degrees from the prone position.

55. A method for treating patients with adult respiratory distress syndrome comprising:

securing a patient to a mechanically powered patient support platform;

rotating the patient from a substantially supine position to a substantially prone position; and alternately laterally rotating the patient about a longitudinal axis of the bed across an arc spanning from between positive 15 to 62 degrees from the prone position to a negative 15 to 62 degrees from the prone position.

* * * * *